US011938541B2

(12) United States Patent
Mann et al.

(10) Patent No.: US 11,938,541 B2
(45) Date of Patent: Mar. 26, 2024

(54) METHODS FOR MANUFACTURING A WROUGHT METALLIC ARTICLE FROM A METALLIC-POWDER COMPOSITION

(71) Applicant: The Boeing Company, Chicago, IL (US)

(72) Inventors: Austin E. Mann, Chesterfield, MO (US); Ali Yousefiani, Tustin, CA (US); Joe Pecina, Lynnwood, WA (US)

(73) Assignee: The Boeing Company, Arlington, VA (US)

( * ) Notice: Subject to any disclaimer, the term of this patent is extended or adjusted under 35 U.S.C. 154(b) by 58 days.

(21) Appl. No.: 17/342,690

(22) Filed: Jun. 9, 2021

(65) Prior Publication Data

US 2022/0193766 A1 Jun. 23, 2022

Related U.S. Application Data

(60) Provisional application No. 63/127,255, filed on Dec. 18, 2020.

(51) Int. Cl.
*B22F 3/12* (2006.01)
*B22F 1/00* (2022.01)
(Continued)

(52) U.S. Cl.
CPC ..... *B22F 3/12* (2013.01); *B22F 1/052* (2022.01); *B22F 1/06* (2022.01); *B22F 3/003* (2013.01);
(Continued)

(58) Field of Classification Search
CPC ..... B22F 3/172
See application file for complete search history.

(56) References Cited

U.S. PATENT DOCUMENTS 3,834,004 A * 9/1974 Ayers ..... B22F 3/172 419/48
3,888,636 A * 6/1975 Sczerzenie ..... C22C 1/045 419/25
(Continued)

FOREIGN PATENT DOCUMENTS

CN 106077488 A * 11/2016

OTHER PUBLICATIONS

Martinez, Christine M., et al. "Effects of ballistic impact damage on fatigue crack initiation in Ti—6Al—4V simulated engine blades." Materials Science and Engineering: A 325.1-2 (2002): 465-477. (Year: 2002).*
(Continued)

*Primary Examiner* — Sally A Merkling
*Assistant Examiner* — Sean P. O'Keefe
(74) *Attorney, Agent, or Firm* — Walters & Wasylyna LLC

(57) ABSTRACT

A method for manufacturing a wrought metallic article from metallic-powder compositions comprises steps of (1) compacting the metallic-powder composition to yield a compact, having a surface, a cross-sectional area, and a relative density of less than 100 percent, (2) reducing the cross-sectional area of the compact via an initial forming pass of a rotary incremental forming process so that the compact has a decreased cross-sectional area, and (3) reducing the decreased cross-sectional area of the compact via a subsequent forming pass of the rotary incremental forming process by a greater percentage than that, by which the cross-sectional area of the compact was reduced during the initial forming pass.

20 Claims, 6 Drawing Sheets

(51) Int. Cl.

| | |
|---|---|
| ***B22F 1/052*** | (2022.01) |
| ***B22F 1/06*** | (2022.01) |
| ***B22F 3/00*** | (2021.01) |
| ***B22F 3/17*** | (2006.01) |
| ***B22F 3/24*** | (2006.01) |
| *B22F 3/20* | (2006.01) |

(52) U.S. Cl.
CPC ..... *B22F 3/172* (2013.01); *B22F 1/09* (2022.01); *B22F 3/20* (2013.01); *B22F 2003/248* (2013.01); *B22F 2301/205* (2013.01); *B22F 2304/10* (2013.01)

(56) References Cited

U.S. PATENT DOCUMENTS 6,136,105 A * 10/2000 Spencer ..... C22C 1/045 148/668
9,561,538 B2 2/2017 Yousefiani
2003/0035747 A1* 2/2003 Anderson ..... C22C 33/0264 419/25
2006/0013719 A1* 1/2006 Ichikawa ..... C22C 21/10 419/29

OTHER PUBLICATIONS

Sun, Y., et al. "Enhanced machinability of Ti-5553 alloy from cryogenic machining: comparison with MQL and flood-cooled machining and modeling." Procedia Cirp 31 (2015): 477-482. (Year: 2015).*
V. Duz et al.: "ADMA Process for Hydrogenated Titanium Powder Production," Titanium 2013 (Conference), Las Vegas, NV.

* cited by examiner

METHODS FOR MANUFACTURING A WROUGHT METALLIC ARTICLE FROM A METALLIC-POWDER COMPOSITION

PRIORITY

This application claims priority from U.S. Ser. No. 63/127,255 filed on Dec. 18, 2020.

FIELD

Described herein are methods for manufacturing a wrought metallic article from a metallic-powder composition.

BACKGROUND

Traditionally, wrought metallic products, such as plate, bar, billet, sheet, etc. are manufactured by melting, or, in some cases, double or triple melting, cast ingots and then processing the resulting precursors to final form via a sequence of lengthy and energy intensive thermo-mechanical conversion processes such as rolling, forming, etc. The steps required to fully process large cast ingots in a manner, described above, are energy and time intensive and require a high degree of skill to produce material of acceptable quality for consumption, e.g. in the aerospace industry. Powder metallurgy approaches can circumvent some of the aforementioned processing steps, thus making high-performance metallic materials more affordable. However, existing powder-based metallurgy techniques typically involve consolidation of loose metal powder into stock shapes, such as bar and plate, or near-net-shape parts or preforms using, for example, cold isostatic pressing and sintering or hot isostatic pressing. One drawback of these process steps is the relatively high cost required to arrive at a close to 100% dense and durable product.

SUMMARY

Accordingly, apparatuses and methods, intended to address at least the above-identified concerns, would find utility.

The following is an example of the subject matter, disclosed herein.

Disclosed herein is a method for manufacturing a wrought metallic article from metallic-powder compositions. The method comprises (1) compacting such metallic-powder compositions to yield a compact, having a surface, a cross-sectional area, and a relative density of less than 100 percent, (2) reducing the cross-sectional area of the compact via an initial forming pass of a rotary incremental forming process so that the compact has a decreased cross-sectional area, and (3) reducing the decreased cross-sectional area of the compact via a subsequent forming pass of the rotary incremental forming process by a greater percentage than that, by which the cross-sectional area of the compact was reduced during the initial forming pass.

The method provides for a manufacturing cost reduction due to (1) using a less-dense compact and then (2) using a rotary incremental forming process on the less-dense compact to achieve the desired final density and shape.

BRIEF DESCRIPTION OF THE DRAWINGS

Reference will now be made to the accompanying drawings, which are not necessarily drawn to scale, and where like reference characters designate the same or similar parts throughout the several views. In the drawings.

DETAILED DESCRIPTION

In FIGS. 1-6, referred to above, solid lines, if any, connecting various elements and/or components may represent mechanical, electrical, fluid, optical, electromagnetic and other couplings and/or combinations thereof. As used herein, "coupled" means associated directly as well as indirectly. For example, a member A may be directly associated with a member B, or may be indirectly associated therewith, e.g., via another member C. It will be understood that not all relationships among the various disclosed elements are necessarily represented. Accordingly, couplings other than those depicted in the block diagrams may also exist. Dashed lines, if any, connecting blocks designating the various elements and/or components represent couplings similar in function and purpose to those represented by solid lines; however, couplings represented by the dashed lines may either be selectively provided or may relate to alternative examples of the subject matter, disclosed herein. Likewise, elements and/or components, if any, represented with dashed lines, indicate alternative examples of the subject matter, disclosed herein. One or more elements shown in solid and/or dashed lines may be omitted from a particular example without departing from the scope of the subject matter, disclosed herein. Environmental elements, if any, are represented with dotted lines. Virtual (imaginary) elements may also be shown for clarity. Those skilled in the art will appreciate that some of the features illustrated in FIGS. 1 and 3 may be combined in various ways without the need to include other features described in FIGS. 1 and 3, other drawing figures, and/or the accompanying disclosure, even though such combination or combinations are not explicitly illustrated herein. Similarly, additional features not limited to the examples presented, may be combined with some or all of the features shown and described herein.

Figure 1:
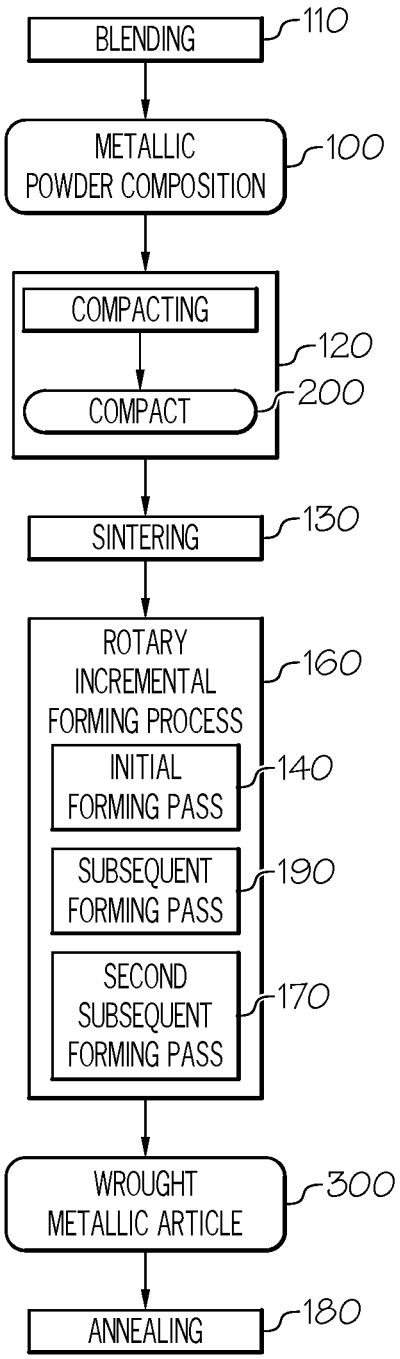
FIG. 1 is a block diagram of a method, according to one or more examples of the subject matter, disclosed herein, for manufacturing a wrought metallic article from metallic-powder compositions.
Figure 3:
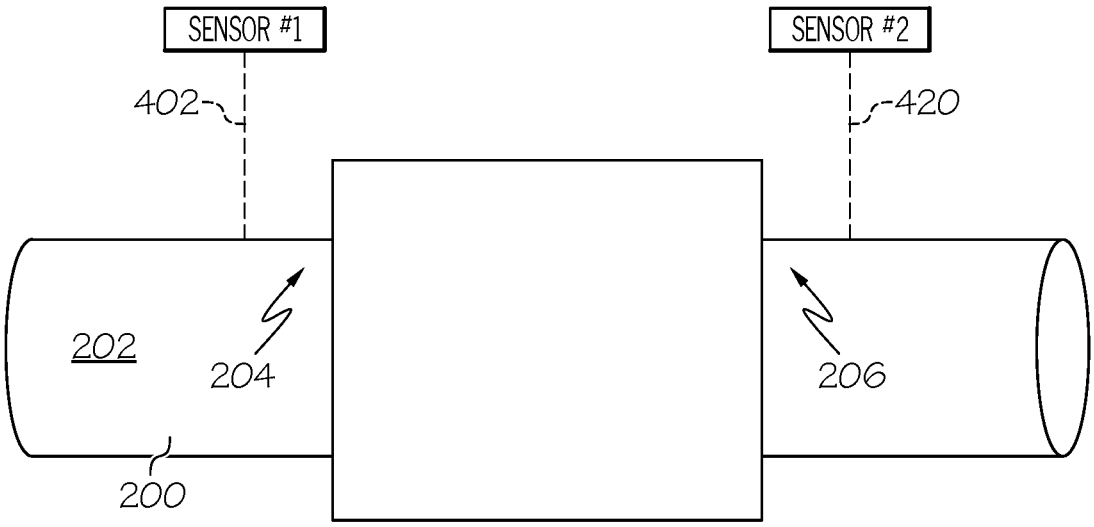
FIG. 3 is a schematic, perspective view of a system, according to one or more examples of the subject matter, disclosed herein, for measuring and controlling parameters during manufacturing of a wrought metallic article from metallic-powder compositions.

In FIGS. 1 and 3, referred to above, the blocks may represent operations and/or portions thereof and lines connecting the various blocks do not imply any particular order or dependency of the operations or portions thereof. Blocks represented by dashed lines indicate alternative operations and/or portions thereof. Dashed lines, if any, connecting the various blocks represent alternative dependencies of the operations or portions thereof. It will be understood that not all dependencies among the various disclosed operations are necessarily represented. FIGS. 1 and 3 and the accompanying disclosure describing the operations of the method(s) set forth herein should not be interpreted as necessarily determining a sequence in which the operations are to be performed. Rather, although one illustrative order is indicated, it is to be understood that the sequence of the operations may be modified when appropriate. Accordingly, certain operations may be performed in a different order or simultaneously. Additionally, those skilled in the art will appreciate that not all operations described need be performed.

In the following description, numerous specific details are set forth to provide a thorough understanding of the disclosed concepts, which may be practiced without some or all of these particulars. In other instances, details of known devices and/or processes have been omitted to avoid unnecessarily obscuring the disclosure. While some concepts will be described in conjunction with specific examples, it will be understood that these examples are not intended to be limiting.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

Reference herein to "one or more examples" means that one or more feature, structure, or characteristic described in connection with the example is included in at least one implementation. The phrase "one or more examples" in various places in the specification may or may not be referring to the same example.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

Illustrative, non-exhaustive examples of the subject matter, disclosed herein, are provided below.

Referring generally to FIGS. 1 and 2A-2E for illustrative purposes only and not be way of limitation, the following portion of this paragraph delineates example 1 of the subject matter, disclosed herein. According to example 1, a method for manufacturing wrought metallic article 300 from metallic-powder composition 100 comprises a step of (block 120) compacting metallic-powder composition 100 to yield compact 200, having surface 202, a cross-sectional area, and a relative density of less than 100 percent. The method also comprises a step of (block 140) reducing the cross-sectional area of compact 200 via an initial forming pass of a rotary incremental forming process so that compact 200 has a decreased cross-sectional area. The method additionally comprises a step of (block 190) reducing the decreased cross-sectional area of compact 200 via a subsequent forming pass of the rotary incremental forming process by a greater percentage than that, by which the cross-sectional area of compact 200 was reduced during the initial forming pass.

Figure 2A:
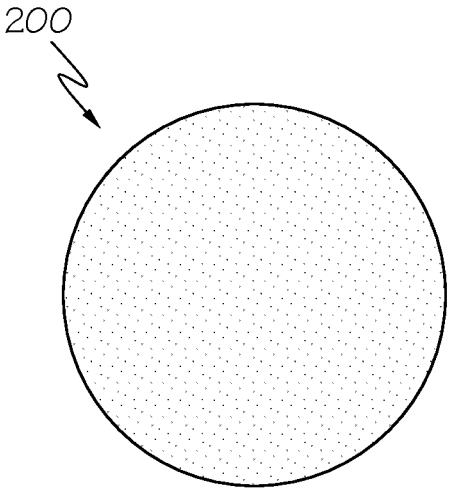
FIG. 2A is a schematic, elevation, sectional view of a compact according to one or more examples of the subject matter, disclosed herein.

Method facilitates manufacturing cost reduction due to (1) using a less-dense compact and then (2) using a rotary incremental forming process on the less-dense compact to achieve the desired final density and shape. FIG. 2A illustrates the initial form of compact 200. In one or more examples, relative density is defined as the actual density divided by the pore-free density. The initial rotary-incremental-forming pass is meant to reduce or substantially close-up any surface imperfections. The first pass is a relatively light pass compared to during subsequent passes to ensure that the pass does not crack the cylindrical bar stock, which still has a little porosity after the consolidation steps.

Referring to FIG. 1 for illustrative purposes only and not by way of limitation, the following portion of this paragraph delineates example 2 of the subject matter, disclosed herein. According to example 2, which encompasses example 1, above, the initial forming pass of the rotary incremental forming process reduces the cross-sectional area of compact 200 by at most 2 percent.

Figure 2B:
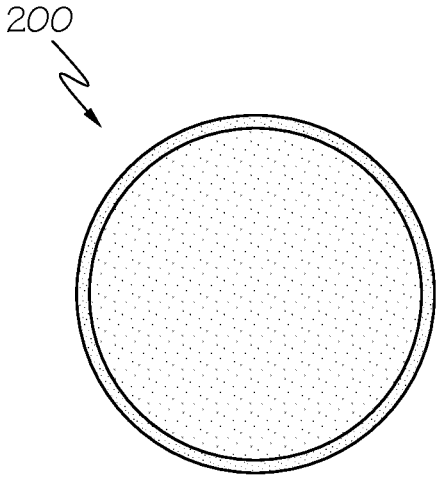
FIG. 2B is a schematic, elevation, sectional view of a compact according to one or more examples of the subject matter, disclosed herein.

The initial forming pass of the rotary incremental forming process provides for maintained integrity of compact 200 in a less-dense state, while forming a densified skin on compact 200 that inhibits oxidation. FIG. 2*b* illustrates an exemplary schematic of compact 200 after an initial forming pass. In one or more examples, the initial forming pass of a rotary incremental forming process reduces the cross-sectional area of compact 200 by less than approximately 2 percent in each pass until substantially all internal porosity and each of the additional forming steps reduces the cross-sectional area by between approximately 2% and approximately 3% when compared to the original cross-sectional area following consolidation. The number of passes that occur after the initial pass is determined based upon the number needed to achieve approximately 100% density. In one or more examples, forming occurs in the $\alpha+\beta$ regime, that is below the $\beta$ transus of the given titanium alloy, which is approximately 1832° F. or 1000° C. for Ti-6Al-4V.

Any numerical values and ranges provided herein are approximate within the scientific convention of rounding. Thus, in example 2 above, the initial forming pass of the rotary incremental forming process reduces the cross-sectional area of compact 200 by at most approximately 2 percent, meaning the initial forming pass of the rotary incremental forming process may reduce the cross-sectional area slightly more or slightly less than 2 percent.

Referring to FIG. 2B for illustrative purposes only and not by way of limitation, the following portion of this paragraph delineates example 3 of the subject matter, disclosed herein. According to example 3, which encompasses example 1, above, the initial forming pass of the rotary incremental forming process reduces the cross-sectional area of compact 200 by at most 1.5 percent.

The initial forming pass of the rotary incremental forming process provides for maintained integrity of compact 200 in a less-dense state, while forming a densified skin on compact 200 that inhibits oxidation.

Referring to FIG. 2B for illustrative purposes only and not by way of limitation, the following portion of this paragraph delineates example 4 of the subject matter, disclosed herein. According to example 4, which encompasses example 1, above, the initial forming pass of the rotary incremental forming process reduces the cross-sectional area of compact 200 by at most 1 percent.

The initial forming pass of the rotary incremental forming process provides for maintained integrity of compact 200 in a less-dense state, while forming a densified skin on compact 200 that inhibits oxidation.

Figure 2C:
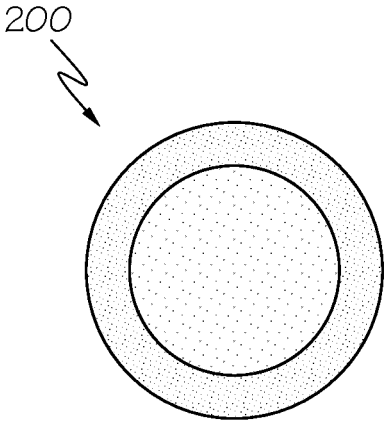
FIG. 2C is a schematic, elevation, sectional view of a compact according to one or more examples of the subject matter, disclosed herein.

Referring to FIG. 2C for illustrative purposes only and not by way of limitation, the following portion of this paragraph delineates example 5 of the subject matter, disclosed herein. According to example 5, which encompasses any one of examples 1 to 4, above, an amount, by which the initial forming pass of the rotary incremental forming process reduces the cross-sectional area of compact 200, is sufficient to close surface imperfections of compact 200 without damaging compact 200.

The initial forming pass of the rotary incremental forming process provides for maintained integrity of compact 200 in a less-dense state, while forming a densified skin on compact 200 that inhibits oxidation.

Referring to FIG. 2C for illustrative purposes only and not by way of limitation, the following portion of this paragraph delineates example 6 of the subject matter, disclosed herein. According to example 6, which encompasses any one of examples 1 to 5, above, the subsequent forming pass of the rotary incremental forming process reduces the decreased cross-sectional area of compact 200 by at least 5 percent.

The initial forming pass of the rotary incremental forming process provides for desired densification of compact 200 at reduced cost. FIG. 2C illustrates an exemplary schematic of compact 200 after a subsequent forming pass.

Referring to FIG. 2C for illustrative purposes only and not by way of limitation, the following portion of this paragraph delineates example 7 of the subject matter, disclosed herein. According to example 7, which encompasses any one of examples 1 to 5, above, the subsequent forming pass of the rotary incremental forming process reduces the decreased cross-sectional area of compact 200 by at least 10 percent.

The subsequent forming pass of the rotary incremental forming process achieves the desired densification of compact 200 at reduced cost.

Figure 2D:
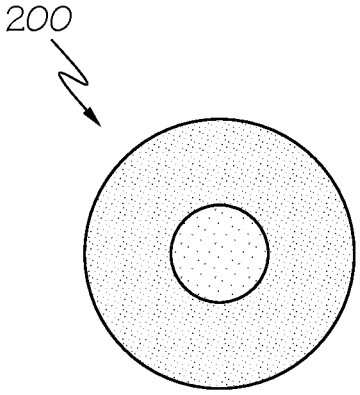
FIG. 2D is a schematic, elevation, sectional view of a compact according to one or more examples of the subject matter, disclosed herein.

Referring to FIG. 2D for illustrative purposes only and not by way of limitation, the following portion of this paragraph delineates example 8 of the subject matter, disclosed herein. According to example 8, which encompasses any one of examples 1 to 5, above, the subsequent forming pass of the rotary incremental forming process reduces the decreased cross-sectional area of compact 200 by at least 3 percent so that compact 200 has a further-decreased cross-sectional area. A second subsequent forming pass of the rotary incremental forming process reduces the further-decreased cross-sectional area of compact 200 by at least 6 percent.

The combination of the subsequent forming pass of the rotary incremental forming process and the second subsequent forming pass of the rotary incremental forming process achieves the desired densification of compact 200 at a reduced cost. FIG. 2D illustrates an exemplary schematic of compact 200 after a second subsequent forming pass.

Referring to FIGS. 2C and 2D for illustrative purposes only and not by way of limitation, the following portion of this paragraph delineates example 9 of the subject matter, disclosed herein. According to example 9, which encompasses any one of examples 1 to 5, above, the subsequent forming pass of the rotary incremental forming process reduces the cross-sectional area of compact 200 by at least 5 percent so that compact 200 has a further-decreased cross-sectional area. A second subsequent forming pass of the rotary incremental forming process reduces the further-decreased cross-sectional area of compact 200 by at least 10 percent.

The combination of the subsequent forming pass of the rotary incremental forming process and the second subsequent forming pass of the rotary incremental forming process achieves the desired densification of compact 200 at a reduced cost.

Referring to FIG. 1 for illustrative purposes only and not by way of limitation, the following portion of this paragraph delineates example 10 of the subject matter, disclosed herein. According to example 10, which encompasses any one of examples 1 to 9, above, following the step of (block 120) compacting metallic-powder composition 100, the relative density of compact 200 is at most 98 percent.

The step of compacting metallic-powder composition 100 yields a manufacturing cost reduction due to using a less-dense compact.

Referring to FIG. 1 for illustrative purposes only and not by way of limitation, the following portion of this paragraph delineates example 11 of the subject matter, disclosed herein. According to example 11, which encompasses any one of examples 1 to 9, above, following the step of (block 120) compacting metallic-powder composition 100, the relative density of compact 200 is at most 97 percent.

The step of compacting metallic-powder composition 100 produces a relative density of compact 200 of at most approximately 97 percent, thus yielding a manufacturing cost reduction due to using a less-dense compact.

Referring to FIG. 1 for illustrative purposes only and not by way of limitation, the following portion of this paragraph delineates example 12 of the subject matter, disclosed herein. According to example 12, which encompasses any one of examples 1 to 9, above, following the step of (block 120) compacting metallic-powder composition 100, the relative density of compact 200 is at most 96 percent.

The step of compacting metallic-powder composition 100 produces a relative density of compact 200 of at most approximately 96 percent, thus yielding a manufacturing cost reduction due to using a less-dense compact.

Referring to FIG. 1 for illustrative purposes only and not by way of limitation, the following portion of this paragraph delineates example 13 of the subject matter, disclosed herein. According to example 13, which encompasses any one of examples 1 to 9, above, following the step of (block 120) compacting metallic-powder composition 100, the relative density of compact 200 is at most 95 percent.

The step of compacting metallic-powder composition 100 produces a relative density of compact 200 of at most approximately 95 percent, thus yielding a manufacturing cost reduction due to using a less-dense compact.

Referring to FIG. 1 for illustrative purposes only and not by way of limitation, the following portion of this paragraph delineates example 14 of the subject matter, disclosed herein. According to example 14, which encompasses any one of examples 1 to 9, above, following the step of (block 120) compacting metallic-powder composition 100, the relative density of compact 200 is at most 90 percent.

The step of compacting metallic-powder composition 100 produces a relative density of compact 200 of at most approximately 90 percent, thus yielding a manufacturing cost reduction due to using a less-dense compact.

Referring to FIG. 1 for illustrative purposes only and not by way of limitation, the following portion of this paragraph delineates example 15 of the subject matter, disclosed herein. According to example 15, which encompasses any one of examples 1 to 9, above, following the step of (block 120) compacting metallic-powder composition 100, the relative density of compact 200 is at most 85 percent.

The step of compacting metallic-powder composition 100 produces a relative density of compact 200 of at most approximately 85 percent, thus yielding a manufacturing cost reduction due to using a less-dense compact.

Referring to FIG. 1 for illustrative purposes only and not by way of limitation, the following portion of this paragraph delineates example 16 of the subject matter, disclosed herein. According to example 16, which encompasses any one of examples 1 to 9, above, following the step of (block 120) compacting metallic-powder composition 100, the relative density of compact 200 is at most 80 percent.

The step of compacting metallic-powder composition 100 produces a relative density of compact 200 of at most approximately 80 percent, thus yielding a manufacturing cost reduction due to using a less-dense compact.

Referring to FIG. 1 for illustrative purposes only and not by way of limitation, the following portion of this paragraph delineates example 17 of the subject matter, disclosed herein. According to example 17, which encompasses any one of examples 1 to 9, above, following the step of (block 120) compacting metallic-powder composition 100, the relative density of compact 200 is at most 70 percent.

The step of compacting metallic-powder composition 100 produces a relative density of compact 200 of at most approximately 70 percent, thus yielding a manufacturing cost reduction due to using a less-dense compact.

Referring to FIG. 1 for illustrative purposes only and not by way of limitation, the following portion of this paragraph delineates example 18 of the subject matter, disclosed herein. According to example 18, which encompasses any one of examples 1 to 17, above, the step of (block 120) compacting metallic-powder composition 100 comprises hydraulic pressing of metallic-powder composition 100.

The step of compacting metallic-powder composition 100 with hydraulic pressing produces a relative density of compact 200, thus yielding a manufacturing cost reduction due to using a less-dense compact.

Referring to FIG. 1 for illustrative purposes only and not by way of limitation, the following portion of this paragraph delineates example 19 of the subject matter, disclosed herein. According to example 19, which encompasses example 18, above, the hydraulic pressing exerts a pressure of at least 5 ksi on metallic-powder composition 100.

The step of compacting metallic-powder composition 100 with hydraulic pressing at a pressure of at least approximately 5 ksi produces a relative density of compact 200, thus yielding a manufacturing cost reduction due to using a less-dense compact, as well as a manufacturing cost reduction due to using a relatively low pressure.

According to one or more examples, the hydraulic pressing exerts a pressure of at least 40 ksi on metallic-powder composition 100. According to one or more examples, the hydraulic pressing exerts a pressure of at least 45 ksi on metallic-powder composition 100

Referring to FIG. 1 for illustrative purposes only and not by way of limitation, the following portion of this paragraph delineates example 20 of the subject matter, disclosed herein. According to example 20, which encompasses any one of examples 1 to 17, above, the step of (block 120) compacting metallic-powder composition 100 comprises cold isostatic pressing of metallic-powder composition 100.

The step of compacting metallic-powder composition 100 with cold isostatic pressing produces a relative density of compact 200, thus yielding a manufacturing cost reduction due to using a less-dense compact. In one or more examples, cold isostatic pressing is conducted at room temperature under isostatic pressure. In one or more examples, the cold isostatic pressing of metallic-powder composition 100 is followed by sintering to achieve additional desirable material properties.

Referring to FIG. 1 for illustrative purposes only and not by way of limitation, the following portion of this paragraph delineates example 21 of the subject matter, disclosed herein. According to example 21, which encompasses any one of examples 1 to 17, above, the step of (block 120) compacting metallic-powder composition 100 comprises hot isostatic pressing of metallic-powder composition 100.

The step of compacting metallic-powder composition 100 with hot isostatic pressing produces a relative density of compact 200, thus yielding a manufacturing cost reduction due to using a less-dense compact.

Various compaction techniques can be used for or during the step of (block 120) compacting metallic-powder composition 100. In one or more examples, the step of (block 130) sintering compact 200, such as by spark plasma sintering or the like, can be performed simultaneously with the step of (block 120) compacting metallic-powder composition 100.

Referring to FIG. 1 for illustrative purposes only and not by way of limitation, the following portion of this paragraph delineates example 22 of the subject matter, disclosed herein. According to example 22, which encompasses examples 1 to 21, above, method further comprises a step of (block 130) sintering compact 200 prior to the step of reducing the cross-sectional area of compact 200 via the initial forming pass.

The step of sintering compact 200 prior to the step of reducing the cross-sectional area of compact 200 advantageously consolidates compact 200 to a less-dense state. In one or more examples, compact 200 is heat treated at an elevated temperature either in a vacuum or inert gas, such as argon, partial pressure environment to promote diffusion and homogenization, as well as effectively reduce or eliminate porosity by diffusion bonding. Diffusion bonding is dependent upon the sintering temperature.

Referring to FIG. 1 for illustrative purposes only and not by way of limitation, the following portion of this paragraph delineates example 23 of the subject matter, disclosed herein. According to example 23, which encompasses example 22, above, the step of (block 130) sintering compact 200 is performed in an inert-gas environment.

The step of sintering compact 200 in an inert-gas environment prior to the step of reducing the cross-sectional area of compact 200 advantageously consolidates compact 200 to a less-dense state while simultaneously inhibiting corrosion.

When an inert-gas environment is used, such as an argon environment, it is possible that some hydrogen may be introduced to the inert-gas environment, such as by escaping from a $TiH_2$ powder compact. Also, a vacuum environment may be used as an alternative to inert-gas environment.

Various sintering techniques can be used for or during the step of (block 130) sintering compact 200 prior to the step of reducing the cross-sectional area of compact 200 via the initial forming pass. In one or more examples, spark plasma sintering is used for or during the step of (block 130) sintering compact 200.

Referring to FIG. 1 for illustrative purposes only and not by way of limitation, the following portion of this paragraph delineates example 24 of the subject matter, disclosed herein. According to example 24, which encompasses example 23, above, metallic-powder composition 100 comprises titanium. The step of (block 130) sintering compact 200 comprises heating compact 200 to a temperature between 1,200° F. and 2,000° F.

For metallic-powder composition 100 comprising titanium, the step of sintering compact 200 including heating compact 200 to a temperature between approximately 1,200° F. and approximately 2,000° F. yields a less expensive method for titanium powder metallurgy.

In one or more examples, the step of (block 130) sintering compact 200 comprises heating compact 200 to a temperature between 1,200° F. and 2,000° F. and, after temperature stabilization, holding the compact 200 at the temperature between 1,200° F. and 2,000° F. for about 1 hour to about 8 hours, depending on load size.

In another example, the step of (block 130) sintering compact 200 comprises heating compact 200 to a temperature between 1,200° F. and 2,600° F. and, after temperature stabilization, holding the compact 200 at the temperature between 1,200° F. and 2,600° F. for about 1 hour to about 8 hours, depending on load size.

In another example, the step of (block 130) sintering compact 200 comprises heating compact 200 to a temperature between 2,200° F. and 2,400° F. and, after temperature stabilization, holding the compact 200 at the temperature between 2,200° F. and 2,400° F. for about 1 hour to about 8 hours, depending on load size.

Referring to FIG. 1 for illustrative purposes only and not by way of limitation, the following portion of this paragraph delineates example 25 of the subject matter, disclosed herein. According to example 25, which encompasses any one of examples 1 to 23, above, metallic-powder composition 100 comprises titanium.

The disclosed method utilizing titanium in metallic-powder composition 100 yields a less expensive method for titanium powder metallurgy.

Referring to FIG. 1 for illustrative purposes only and not by way of limitation, the following portion of this paragraph delineates example 26 of the subject matter, disclosed herein. According to example 26, which encompasses examples 1 to 25, above, metallic-powder composition 100 comprises Ti-6Al-4V.

The disclosed method utilizing Ti-6Al-4V in metallic-powder composition 100 yields a less expensive method for titanium powder metallurgy.

Referring to FIG. 1 for illustrative purposes only and not by way of limitation, the following portion of this paragraph delineates example 27 of the subject matter, disclosed herein. According to example 27, which encompasses any one of examples 1 to 23, above, metallic-powder composition 100 comprises Ti-5Al-5Mo-5V-3Cr.

Utilizing Ti-5Al-5Mo-5V-3Cr in metallic-powder composition 100 yields a less expensive method for titanium powder metallurgy.

Referring to FIG. 1 for illustrative purposes only and not by way of limitation, the following portion of this paragraph delineates example 28 of the subject matter, disclosed herein. According to example 28, which encompasses any one of examples 1 to 23, above, metallic-powder composition 100 comprises at least one of aluminum; aluminum alloy; a metal-matrix composite, comprising aluminum; titanium; titanium alloy; a metal-matrix composite, comprising titanium; a superalloy; iron; iron alloy; a metal-matrix composite, comprising iron; nickel; nickel alloy; a metal-matrix composite, comprising nickel; cobalt; cobalt alloy; a metal-matrix composite, comprising cobalt; magnesium; magnesium alloy; a metal-matrix composite, comprising magnesium; zinc; zinc alloy; a metal-matrix composite, comprising zinc; a refractory metal; a refractory metal alloy; a metal-matrix composite, comprising a refractory metal; copper; copper alloy; a metal-matrix composite, comprising copper; a precious metal; a precious-metal alloy; a metal-matrix composite, comprising a precious metal; zirconium; zirconium alloy; a metal-matrix composite, comprising zirconium; hafnium; hafnium alloy; a metal-matrix composite, comprising hafnium; intermetallics; a complex concentrated alloy; a metal-matrix composite, comprising a complex concentrated alloy; a high-entropy alloy; a metal-matrix composite, comprising a high-entropy alloy; a medium-entropy alloy; a metal-matrix composite, comprising a medium-entropy alloy; a multicomponent alloy; and a metal-matrix composite, comprising a multicomponent alloy.

Utilizing at least one of aluminum; aluminum alloy; a metal-matrix composite, comprising aluminum; titanium; titanium alloy; a metal-matrix composite, comprising titanium; a superalloy; iron; iron alloy; a metal-matrix composite, comprising iron; nickel; nickel alloy; a metal-matrix composite, comprising nickel; cobalt; cobalt alloy; a metal-matrix composite, comprising cobalt; magnesium; magnesium alloy; a metal-matrix composite, comprising magnesium; zinc; zinc alloy; a metal-matrix composite, comprising zinc; a refractory metal; a refractory metal alloy; a metal-matrix composite, comprising a refractory metal; copper; copper alloy; a metal-matrix composite, comprising copper; a precious metal; a precious-metal alloy; a metal-matrix composite, comprising a precious metal; zirconium; zirconium alloy; a metal-matrix composite, comprising zirconium; hafnium; hafnium alloy; a metal-matrix composite, comprising hafnium; intermetallics; a complex concentrated alloy; a metal-matrix composite, comprising a complex concentrated alloy; a high-entropy alloy; a metal-matrix composite, comprising a high-entropy alloy; a medium-entropy alloy; a metal-matrix composite, comprising a medium-entropy alloy; a multicomponent alloy; and a metal-matrix composite, comprising a multicomponent alloy in metallic-powder composition 100 yields a less expensive method for powder metallurgy.

Referring to FIG. 1 for illustrative purposes only and not by way of limitation, the following portion of this paragraph delineates example 29 of the subject matter, disclosed herein. According to example 29, which encompasses any one of examples 1 to 28, above, the method further comprises (block 110) blending a first metallic-powder component, having a first composition, with a second metallic-powder component, having a second composition, to yield metallic-powder composition 100. The first composition is different from the second composition.

Utilizing a blend of a first metallic-powder component, having a first composition, with a second metallic-powder component, having a second composition, to yield metallic-powder composition 100 yields a reduction in manufacturing costs. In one or more examples, non-spherical titanium or titanium-alloy powder is blended with alloying elements such as vanadium and aluminum as needed to produce a homogenous mixture of constituents, such that the mixture is representative of the intended alloy chemistry. In one or more examples, the blend comprises Ti-6Al-4V.

Referring to FIG. 1 for illustrative purposes only and not by way of limitation, the following portion of this paragraph delineates example 30 of the subject matter, disclosed herein. According to example 30, which encompasses any one of examples 1 to 29, above, metallic-powder composition 100 comprises non-spherical particles.

The inclusion of non-spherical particles in metallic-powder composition 100 affords the ability to ultimately achieve a desired density and shape using less expensive powder starting materials. In one or more examples, non-spherical particles are granular.

In one or more examples, metallic-powder composition 100 comprises a blend of spherical particles and non-spherical particles. Blends having various proportions of spherical particles and non-spherical particles are contemplated.

Referring to FIG. 1 for illustrative purposes only and not by way of limitation, the following portion of this paragraph delineates example 31 of the subject matter, disclosed herein. According to example 31, which encompasses any one of examples 1 to 30, above, metallic-powder composition 100 has a particle-size distribution such that at least 90 percent of metallic-powder composition 100 is composed of particles, having a maximum dimension that is less than 170 μm, at least 50 percent of metallic-powder composition 100 is composed of particles, having a maximum dimension that is less than 100 μm, and at least 10 percent of metallic-powder composition 100 is composed of particles, having a maximum dimension that is less than 40 μm.

Confining the makeup of metallic-powder composition 100 to a particle-size distribution such that at least approximately 90 percent of metallic-powder composition 100 is composed of particles, having a maximum dimension that is less than approximately 170 μm, at least approximately 50 percent of metallic-powder composition 100 is composed of particles, having a maximum dimension that is less than approximately 100 μm, and at least approximately 10 percent of metallic-powder composition 100 is composed of particles, having a maximum dimension that is less than approximately 40 μm affords the ability to ultimately achieve desired density and shape using less expensive powder starting materials.

In one or more examples, metallic-powder composition 100 comprises a blend of relatively small particles and relatively large particles. Blends having various proportions of relatively small particles and relatively large particles are contemplated Referring to FIG. 1 for illustrative purposes only and not by way of limitation, the following portion of this paragraph delineates example 32 of the subject matter, disclosed herein. According to example 32, which encompasses any one of examples 1 to 31, above, wherein the rotary incremental forming process is a rotary forging process.

Using a rotary forging process for a rotary incremental forming process on compact 200 in a less-dense state to achieve desired final density and shape offers reduction in manufacturing costs.

Referring to FIG. 1 for illustrative purposes only and not by way of limitation, the following portion of this paragraph delineates example 33 of the subject matter, disclosed herein. According to example 33, which encompasses any one of examples 1 to 31, above, the rotary incremental forming process is a rotary swaging process.

Using a rotary swaging process for a rotary incremental forming process on compact 200 in a less-dense state to achieve desired final density and shape offers reduction in manufacturing costs.

Referring to FIG. 1 for illustrative purposes only and not by way of limitation, the following portion of this paragraph delineates example 34 of the subject matter, disclosed herein. According to example 34, which encompasses any one of examples 1 to 31, above, the rotary incremental forming process is a rotary pilgering process.

Using a rotary pilgering process for a rotary incremental forming process on compact 200 in a less-dense state to achieve desired final density and shape offers reduction in manufacturing costs.

Referring to FIG. 1 for illustrative purposes only and not by way of limitation, the following portion of this paragraph delineates example 35 of the subject matter, disclosed herein. According to example 35, which encompasses any one of examples 1 to 31, above, the rotary incremental forming process is a rotary piercing process.

Using a rotary piercing process for a rotary incremental forming process on compact 200 in a less-dense state to achieve desired final density and shape offers reduction in manufacturing costs.

Referring to FIG. 1 for illustrative purposes only and not by way of limitation, the following portion of this paragraph delineates example 36 of the subject matter, disclosed herein. According to example 36, which encompasses any one of examples 1 to 35, above, the rotary incremental forming process is performed at a rotary-incremental-forming-process temperature (in degrees Kelvin), and the rotary-incremental-forming-process temperature is at most 95 percent of a melting temperature (in degrees Kelvin) of metallic-powder composition 100.

Performing a rotary incremental forming process on compact 200 at a rotary-incremental-forming-process temperature that is at most approximately 95 percent of a melting temperature (in degrees Kelvin) of metallic-powder composition 100 offers reduction in manufacturing costs.

In one or more examples, the rotary-incremental-forming-process temperature is at most 90 percent of a melting temperature (in degrees Kelvin) of metallic-powder composition 100.

Referring to FIG. 1 for illustrative purposes only and not by way of limitation, the following portion of this paragraph delineates example 37 of the subject matter, disclosed herein. According to example 37, which encompasses example 36, above, the rotary-incremental-forming-process temperature is at least 20 percent of the melting temperature (in degrees Kelvin) of metallic-powder composition 100.

Performing a rotary incremental forming process on compact 200 at a rotary-incremental-forming-process temperature that is at least approximately 20 percent of a melting temperature (in degrees Kelvin) of metallic-powder composition 100 offers reduction in manufacturing costs.

Referring to FIG. 1 for illustrative purposes only and not by way of limitation, the following portion of this paragraph delineates example 38 of the subject matter, disclosed herein. According to example 38, which encompasses example 36, above, the rotary-incremental-forming-process temperature is at least 60 percent of the melting temperature (in degrees Kelvin) of metallic-powder composition 100.

Performing a rotary incremental forming process on compact 200 at a rotary-incremental-forming-process temperature that is at least approximately 60 percent of a melting temperature (in degrees Kelvin) of metallic-powder composition 100 offers reduction in manufacturing costs.

Referring to FIG. 1 for illustrative purposes only and not by way of limitation, the following portion of this paragraph delineates example 39 of the subject matter, disclosed herein. According to example 39, which encompasses any one of examples 1 to 38, above, the step of (block 190) reducing the decreased cross-sectional area of compact 200 via the subsequent forming pass of the rotary incremental forming process is performed at a rotary-incremental-forming-process average equivalent strain rate that ranges from 0.00001 $s^{-1}$ to 100 $s^{-1}$.

Performing the step of reducing the decreased cross-sectional area of compact 200 via the subsequent forming pass of the rotary incremental forming process is performed at a rotary-incremental-forming-process average equivalent strain rate that ranges from approximately 0.00001 $s^{-1}$ to approximately 100 $s^{-1}$ yields a reduction in manufacturing costs due to using a rotary incremental forming process on a less-dense compact to achieve desired final density and shape.

Referring to FIG. 1 for illustrative purposes only and not by way of limitation, the following portion of this paragraph delineates example 40 of the subject matter, disclosed herein. According to example 40, which encompasses any one of examples 1 to 38, above, the step of (block 190) reducing the decreased cross-sectional area of compact 200 via the subsequent forming pass of the rotary incremental forming process is performed at a rotary-incremental-forming-process average equivalent strain rate that ranges from 0.001 $s^{-1}$ to 1 $s^{-1}$.

Performing the step of reducing the decreased cross-sectional area of compact 200 via the subsequent forming pass of the rotary incremental forming process is performed at a rotary-incremental-forming-process average equivalent strain rate that ranges from approximately 0.001 $s^{-1}$ to approximately 1 $s^{-1}$ yields a reduction in manufacturing costs due to using a rotary incremental forming process on a less-dense compact to achieve desired final density and shape.

Figure 2E:
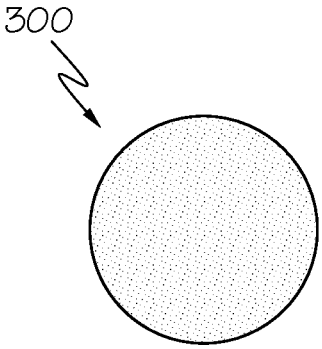
FIG. 2E is a schematic, elevation, sectional view of a wrought metal article according to one or more examples of the subject matter, disclosed herein.

Referring to FIG. 1 and FIG. 2E for illustrative purposes only and not by way of limitation, the following portion of this paragraph delineates example 41 of the subject matter, disclosed herein. According to example 41, which encompasses any one of examples 1 to 40, above, the method further comprises a step of (block 180) annealing compact 200 after the step of (block 190) reducing the decreased cross-sectional area of compact 200 via the subsequent forming pass of the rotary incremental forming process.

The step of annealing compact 200 after the step of reducing the decreased cross-sectional area of compact 200 via the subsequent forming pass of the rotary incremental forming process yields a reduced cost for manufacturing an annealed article.

Figure 4:
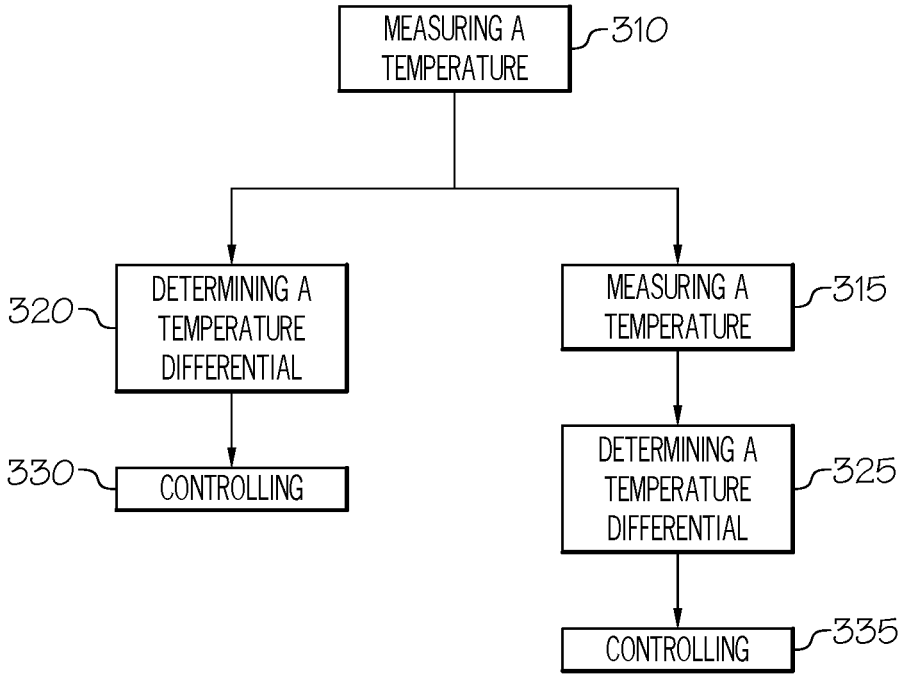
FIG. 4 is a block diagram of a method, according to one or more examples of the subject matter, disclosed herein, for measuring and controlling parameters during manufacturing of a wrought metallic article from metallic-powder compositions.

Referring to FIG. 3 and FIG. 4 for illustrative purposes only and not by way of limitation, the following portion of this paragraph delineates example 42 of the subject matter, disclosed herein. According to example 42, which encompasses any one of examples 1 to 41, above, the method further comprises a step of (block 310), during at least one of the initial forming pass or the subsequent forming pass, measuring a temperature of compact 200 along predetermined portion 204 of surface 202 of compact 200 using beam of electromagnetic radiation 402. The method also comprises a step of (block 320) determining a temperature differential between the temperature of compact 200 along predetermined portion 204 of surface 202 of compact 200 and a predefined target temperature. The method additionally comprises a step of (block 330) controlling, based on the temperature differential, at least one of a relative feed speed of the rotary incremental forming process or a relative rotational speed of the rotary incremental forming process during at least the one of the initial forming pass or the subsequent forming pass.

A further reduction in manufacturing costs by controlling parameters of the rotary incremental forming process. In one or more examples, the rotary incremental forming process is a "smart" process, such that rotational speed and/or feed rate are configured to change based upon on a sensed parameter, for example stress or strain. In one or more examples, the material deformation rate, or strain rate, is configured to change during a single pass and or from one pass to another.

Referring to FIG. 3 and FIG. 4 for illustrative purposes only and not by way of limitation, the following portion of this paragraph delineates example 43 of the subject matter, disclosed herein. According to example 43, which encompasses example 42, above, the step of (block 310) measuring the temperature of compact 200 along predetermined portion 204 of surface 202 of compact 200 using beam of electromagnetic radiation 402, the step of (block 320) determining the temperature differential between the temperature of compact 200 along predetermined portion 204 of surface 202 of compact 200 and the predefined target temperature, and the step of (block 330) controlling, based on the temperature differential, at least one of the relative feed speed of the rotary incremental forming process or the relative rotational speed of the rotary incremental forming process during at least the one of the initial forming pass or the subsequent forming pass are performed in real time.

The added steps of measuring the temperature of compact 200 along predetermined portion 204 of surface 202 of compact 200 using beam of electromagnetic radiation 402, the step of determining the temperature differential between the temperature of compact 200 along predetermined portion 204 of surface 202 of compact 200 and the predefined target temperature, and the step of controlling, based on the temperature differential, at least one of the relative feed speed of the rotary incremental forming process or the relative rotational speed of the rotary incremental forming process during at least the one of the initial forming pass or the subsequent forming pass are performed in real time yields further reduction in manufacturing costs by controlling parameters of the rotary incremental forming process.

Referring to FIG. 3 and FIG. 4 for illustrative purposes only and not by way of limitation, the following portion of this paragraph delineates example 44 of the subject matter, disclosed herein. According to example 44, which encompasses any one of examples 1 to 41, above, the method further comprises a step of (block 310), during at least one of the initial forming pass or the subsequent forming pass, measuring a temperature of compact 200 along predetermined portion 204 of surface 202 of compact 200 using beam of electromagnetic radiation 402. The method also comprises a step of (block 315), during at least the one of the initial forming pass or the subsequent forming pass, measuring a temperature of compact 200 along second predetermined portion 206 of surface 202 of compact 200 using second beam of electromagnetic radiation 420. The method additionally comprises a step of (block 325) determining a temperature differential between the temperature of compact 200 along predetermined portion 204 of surface 202 of compact 200 and the temperature of compact 200 along second predetermined portion 206 of surface 202 of compact 200. The method also comprises a step of (block 335) controlling, based on the temperature differential, at least one of a relative feed speed of the rotary incremental forming process or a relative rotational speed of the rotary incremental forming process during at least the one of the initial forming pass or the subsequent forming pass. Predetermined portion 204 of surface 202 of compact 200 is at a different location on surface 202 than second predetermined portion 206.

The steps, recited in the immediately preceding paragraph further reduce manufacturing costs by controlling parameters of the rotary incremental forming process.

Referring to FIG. 3 and FIG. 4 for illustrative purposes only and not by way of limitation, the following portion of this paragraph delineates example 45 of the subject matter, disclosed herein. According to example 45, which encompasses example 44, above, the step of (block 310) measuring the temperature of compact 200 along predetermined portion 204 of surface 202 of compact 200 using beam of electromagnetic radiation 402, the step of (block 315) measuring the temperature of compact 200 along second predetermined portion 206 of surface 202 of compact 200 using second beam of electromagnetic radiation 420, the step of (block 325) determining the temperature differential between the temperature of compact 200 along predetermined portion 204 of surface 202 of compact 200 and the temperature of compact 200 along second predetermined portion 206 of surface 202 of compact 200, and the step of (block 335) controlling, based on the temperature differential, at least one of a relative feed speed of the rotary incremental forming process or a relative rotational speed of the rotary incremental forming process during at least the one of the initial forming pass or the subsequent forming pass are performed in real time.

The steps, recited in the immediately preceding paragraph, further reduce manufacturing costs by controlling parameters of the rotary incremental forming process.

Referring to FIG. 2E for illustrative purposes only and not by way of limitation, the following portion of this paragraph delineates example 46 of the subject matter, disclosed herein. According to example 46, wrought metallic article 300 is manufactured according to the method of any one of examples 1 to 45, above.

Manufacturing cost reduction due to (1) using a less-dense compact and then (2) using a rotary incremental forming process on the less-dense compact to achieve the desired final density and shape of wrought metallic article 300.

In one or more examples, once wrought metallic article 300 is manufactured according to the method of any one of examples 1 to 45, above, it can then continue to standard wrought processing, such as rolling into sheet, extrusion and drawing, forging, and the like. Also, various other fabrication steps (e.g., machining, welding, and the like) may be performed to the wrought metallic article 300 to yield a final product form/component.

Figure 5:
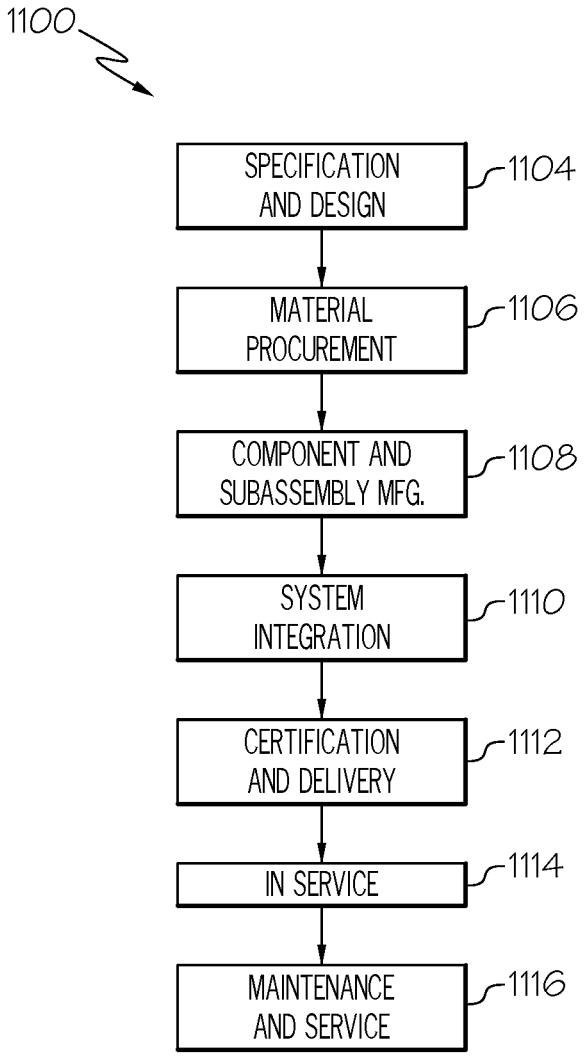
FIG. 5 is a block diagram of aircraft production and service methodology.
Figure 6:
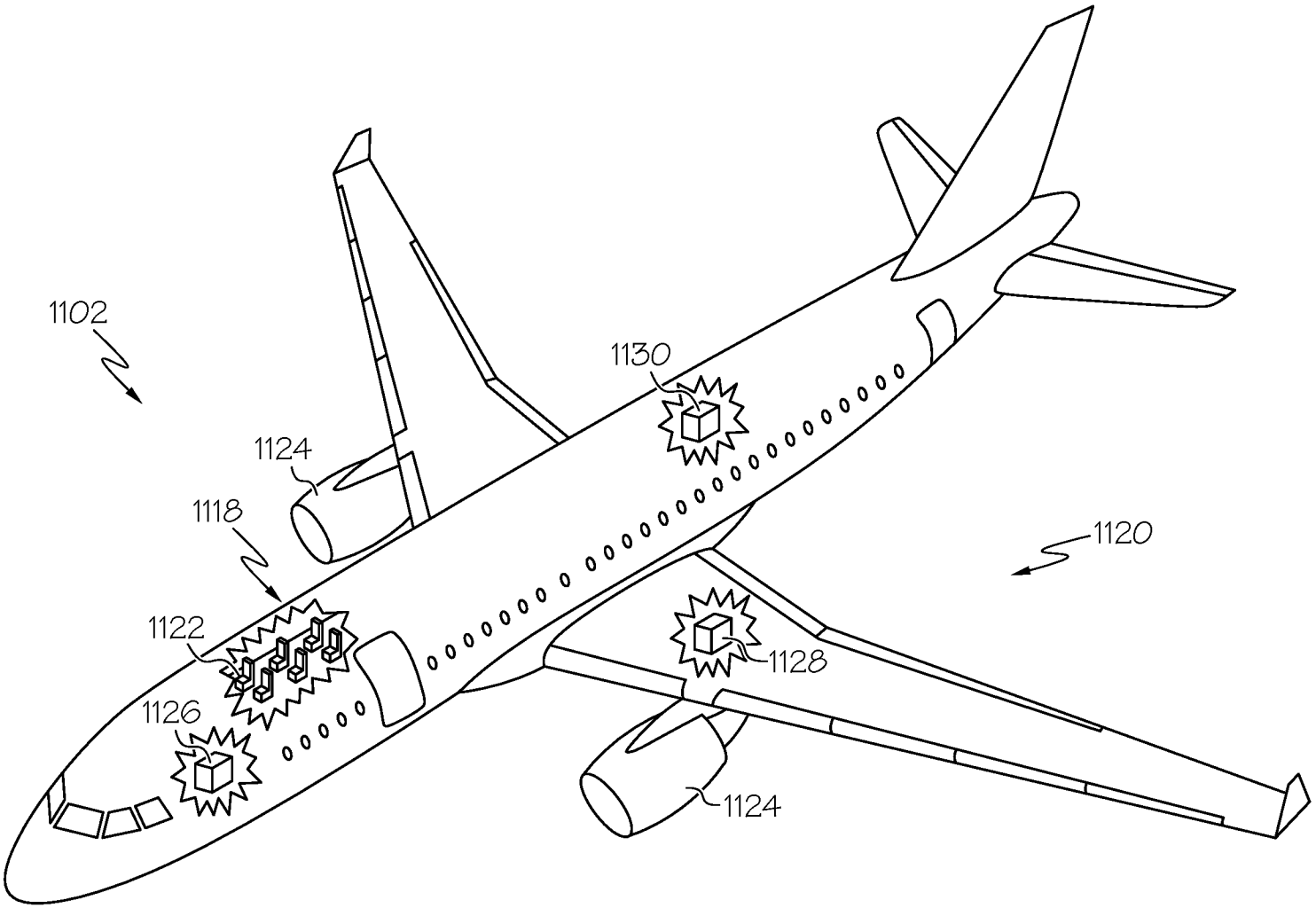
FIG. 6 is a schematic illustration of an aircraft.

Examples of the subject matter, disclosed herein may be described in the context of aircraft manufacturing and service method 1100 as shown in FIG. 5 and aircraft 1102 as shown in FIG. 6. During pre-production, illustrative method 1100 may include specification and design (block 1104) of aircraft 1102 and material procurement (block 1106). During production, component and subassembly manufacturing (block 1108) and system integration (block 1110) of aircraft 1102 may take place. Thereafter, aircraft 1102 may go through certification and delivery (block 1112) to be placed in service (block 1114). While in service, aircraft 1102 may be scheduled for routine maintenance and service (block 1116). Routine maintenance and service may include modification, reconfiguration, refurbishment, etc. of one or more systems of aircraft 1102.

Each of the processes of illustrative method 1100 may be performed or carried out by a system integrator, a third party, and/or an operator (e.g., a customer). For the purposes of this description, a system integrator may include, without limitation, any number of aircraft manufacturers and major-system subcontractors; a third party may include, without limitation, any number of vendors, subcontractors, and suppliers; and an operator may be an airline, leasing company, military entity, service organization, and so on.

As shown in FIG. 6, aircraft 1102 produced by illustrative method 1100 may include airframe 1118 with a plurality of high-level systems 1120 and interior 1122. Examples of high-level systems 1120 include one or more of propulsion system 1124, electrical system 1126, hydraulic system 1128, and environmental system 1130. Any number of other systems may be included. Although an aerospace example is shown, the principles disclosed herein may be applied to other industries, such as the automotive industry. Accordingly, in addition to aircraft 1102, the principles disclosed herein may apply to other vehicles, e.g., land vehicles, marine vehicles, space vehicles, etc.

Apparatus(es) and method(s) shown or described herein may be employed during any one or more of the stages of the manufacturing and service method 1100. For example, components or subassemblies corresponding to component and subassembly manufacturing (block 1108) may be fabricated or manufactured in a manner similar to components or subassemblies produced while aircraft 1102 is in service (block 1114). Also, one or more examples of the apparatus(es), method(s), or combination thereof may be utilized during production stages (block 1108 and block 1110), for example, by substantially expediting assembly of or reducing the cost of aircraft 1102. Similarly, one or more examples of the apparatus or method realizations, or a combination thereof, may be utilized, for example and without limitation, while aircraft 1102 is in service (block 1114) and/or during maintenance and service (block 1116).

Different examples of the apparatus(es) and method(s) disclosed herein include a variety of components, features, and functionalities. It should be understood that the various examples of the apparatus(es) and method(s), disclosed herein, may include any of the components, features, and functionalities of any of the other examples of the apparatus(es) and method(s) disclosed herein in any combination.

Many modifications of examples, set forth herein, will come to mind of one skilled in the art, having the benefit of the teachings, presented in the foregoing descriptions and the associated drawings.

Therefore, it is to be understood that the subject matter, disclosed herein, is not to be limited to the specific examples illustrated and that modifications and other examples are intended to be included within the scope of the appended claims. Moreover, although the foregoing description and the associated drawings describe examples of the subject matter, disclosed herein, in the context of certain illustrative combinations of elements and/or functions, it should be appreciated that different combinations of elements and/or functions may be provided by alternative implementations without departing from the scope of the appended claims.

Accordingly, parenthetical reference numerals in the appended claims are presented for illustrative purposes only and are not intended to limit the scope of the claimed subject matter to the specific examples provided herein.

What is claimed is:

1. A method for manufacturing a wrought metallic article from a metallic-powder composition, the method comprising steps of:

compacting the metallic-powder composition to yield a compact, having a surface, a cross-sectional area, and a relative density of less than 100 percent;

reducing the cross-sectional area of the compact via an initial forming pass of a rotary incremental forming process so that the compact has a decreased cross-sectional area, wherein the initial forming pass of the rotary incremental forming process reduces the cross-sectional area of the compact by at most 2 percent; and reducing the decreased cross-sectional area of the compact via a subsequent forming pass of the rotary incremental forming process by a greater percentage than that, by which the cross-sectional area of the compact was reduced during the initial forming pass.

2. The method according to claim 1, wherein an amount, by which the initial forming pass of the rotary incremental forming process reduces the cross-sectional area of the compact, is sufficient to close surface imperfections of the compact without damaging the compact.

3. The method according to claim 1, wherein the step of compacting the metallic-powder composition comprises hydraulic pressing of the metallic-powder composition.

4. The method according to claim 1, wherein the step of compacting the metallic-powder composition comprises cold isostatic pressing of the metallic-powder composition.

5. The method according to claim 1, wherein the step of compacting the metallic-powder composition comprises hot isostatic pressing of the metallic-powder composition.

6. The method according to claim 1, further comprising a step of sintering the compact prior to the step of reducing the cross-sectional area of the compact via the initial forming pass.

7. The method according to claim 1, wherein the metallic-powder composition comprises titanium.

8. The method according to claim 1, wherein the metallic-powder composition comprises Ti-6Al-4V.

9. The method according to claim 1, wherein the metallic-powder composition comprises Ti-5Al-5Mo-5V-3Cr.

10. The method according to claim 1, wherein the metallic-powder composition comprises at least one of aluminum; aluminum alloy; a metal-matrix composite, comprising aluminum; titanium; titanium alloy; a metal-matrix composite, comprising titanium; a superalloy; iron; iron alloy; a metal-matrix composite, comprising iron; nickel; nickel alloy; a metal-matrix composite, comprising nickel; cobalt; cobalt alloy; a metal-matrix composite, comprising cobalt; a refractory metal; a refractory metal alloy; a metal-matrix composite, comprising a refractory metal; copper; copper alloy; a metal-matrix composite, comprising copper; a precious metal; a precious-metal alloy; a metal-matrix composite, comprising a precious metal; zirconium; zirconium alloy; a metal-matrix composite, comprising zirconium; hafnium; hafnium alloy; a metal-matrix composite, comprising hafnium; intermetallics; a complex concentrated alloy; a metal-matrix composite, comprising a complex concentrated alloy; a high-entropy alloy; a metal-matrix composite, comprising a high-entropy alloy; a medium-entropy alloy; a metal-matrix composite, comprising a medium-entropy alloy; a multicomponent alloy; and a metal-matrix composite, comprising a multicomponent alloy.

11. The method according to claim 1, further comprising blending a first metallic-powder component, having a first composition, with a second metallic-powder component, having a second composition, to yield the metallic-powder composition, wherein the first composition is different from the second composition.

12. The method according to claim 1, wherein the metallic-powder composition comprises non-spherical particles.

13. The method according to claim 1, wherein the metallic-powder composition has a particle-size distribution such that:

at least 90 percent of the metallic-powder composition is composed of particles, having a maximum dimension that is less than 170 μm, at least 50 percent of the metallic-powder composition is composed of particles, having a maximum dimension that is less than 100 μm, and at least 10 percent of the metallic-powder composition is composed of particles, having a maximum dimension that is less than 40 μm.

14. The method according to claim 1, wherein:

the rotary incremental forming process is performed at a rotary-incremental-forming-process temperature (in degrees Kelvin), and the rotary-incremental-forming-process temperature is at most 95 percent of a melting temperature (in degrees Kelvin) of the metallic-powder composition.

15. The method according to claim 1, further comprising a step of annealing the compact after the step of reducing the decreased cross-sectional area of the compact via the subsequent forming pass of the rotary incremental forming process.

16. The method according to claim 1, further comprising steps of:

during at least one of the initial forming pass or the subsequent forming pass, measuring a temperature of the compact along a predetermined portion of the surface of the compact using a beam of electromagnetic radiation;

determining a temperature differential between the temperature of the compact along the predetermined portion of the surface of the compact and a predefined target temperature; and controlling, based on the temperature differential, at least one of a feed speed of the rotary incremental forming process or a rotational speed of the rotary incremental forming process during at least the one of the initial forming pass or the subsequent forming pass.

17. The method according to claim 16, wherein the step of measuring the temperature of the compact along the predetermined portion of the surface of the compact using a beam of electromagnetic radiation, the step of determining the temperature differential between the temperature of the compact along the predetermined portion of the surface of the compact and the predefined target temperature, and the step of controlling, based on the temperature differential, at least one of the feed speed of the rotary incremental forming process or the rotational speed of the rotary incremental forming process during at least the one of the initial forming pass or the subsequent forming pass are performed in real time.

18. The method according to claim 1, further comprising steps of:

during at least one of the initial forming pass or the subsequent forming pass, measuring a temperature of the compact along a predetermined portion of the surface of the compact using a beam of electromagnetic radiation;

during at least the one of the initial forming pass or the subsequent forming pass, measuring a temperature of the compact along a second predetermined portion of the surface of the compact using a second beam of electromagnetic radiation;

determining a temperature differential between the temperature of the compact along the predetermined portion of the surface of the compact and the temperature of the compact along the second predetermined portion of the surface of the compact; and controlling, based on the temperature differential, at least one of a feed speed of the rotary incremental forming process or a rotational speed of the rotary incremental forming process during at least the one of the initial forming pass or the subsequent forming pass, wherein the predetermined portion of the surface of the compact is at a different location on the surface than the second predetermined portion.

19. The method according to claim 18, wherein the step of measuring the temperature of the compact along the predetermined portion of the surface of the compact using a beam of electromagnetic radiation, the step of measuring the temperature of the compact along the second predetermined portion of the surface of the compact using the second beam of electromagnetic radiation, the step of determining the temperature differential between the temperature of the compact along the predetermined portion of the surface of the compact and the temperature of the compact along the second predetermined portion of the surface of the compact, and the step of controlling, based on the temperature differential, at least one of a feed speed of the rotary incremental forming process or a rotational speed of the rotary incremental forming process during at least the one of the initial forming pass or the subsequent forming pass are performed in real time.

20. The method according to claim 1, wherein:

the rotary incremental forming process is performed at a rotary-incremental-forming-process temperature (in degrees Kelvin), and the rotary-incremental-forming-process temperature is at most 90 percent of a melting temperature (in degrees Kelvin) of the metallic-powder composition.

* * * * *